US007868554B2

(12) United States Patent
Varga et al.

(10) Patent No.: US 7,868,554 B2
(45) Date of Patent: Jan. 11, 2011

(54) LIGHT WEIGHT AUTOMOTIVE HID IGNITER

(75) Inventors: Viktor K. Varga, Solon, OH (US); Jianwu Li, Solon, OH (US); Tony Aboumrad, Parma, OH (US)

(73) Assignee: General Electric Company, Schenectady, NY (US)

( * ) Notice: Subject to any disclaimer, the term of this patent is extended or adjusted under 35 U.S.C. 154(b) by 858 days.

(21) Appl. No.: 11/804,500

(22) Filed: May 18, 2007

(65) Prior Publication Data

US 2008/0284340 A1 Nov. 20, 2008

(51) Int. Cl.
*H01J 7/44* (2006.01)
*H01F 27/02* (2006.01)

(52) U.S. Cl. ..... 315/58; 336/90; 336/192

(58) Field of Classification Search ..... 315/82, 315/85, 276, 56, 58; 362/221, 360, 371, 362/372; 336/61, 90, 155, 192, 836
See application file for complete search history.

(56) References Cited

U.S. PATENT DOCUMENTS

| | | | | |
|---|---|---|---|---|
| 2,641,743 | A * | 6/1953 | Bonanno | 336/65 |
| 6,714,111 | B2 * | 3/2004 | Suzuki | 336/110 |
| 6,731,076 | B1 | 5/2004 | Gerhard et al. | |
| 7,142,082 | B2 * | 11/2006 | Kakehashi et al. | 336/182 |
| 7,760,061 | B2 * | 7/2010 | Varga et al. | 336/90 |
| 2004/0066150 | A1 | 4/2004 | Neumeier et al. | |
| 2005/0068143 | A1 | 3/2005 | Behr et al. | |
| 2007/0064437 | A1 | 3/2007 | Blumel et al. | |
| 2008/0055814 | A1 * | 3/2008 | Varga et al. | 361/247 |
| 2008/0055879 | A1 | 3/2008 | Varga et al. | |

FOREIGN PATENT DOCUMENTS

| | | | |
|---|---|---|---|
| DE | 195 21 070 | A1 | 12/1995 |
| EP | 0 855 851 | A2 | 7/1998 |
| WO | WO 2008/027747 | A2 | 3/2008 |

OTHER PUBLICATIONS

PCT/US2008/061486 International Search Report, mailed Nov. 17, 2008.

* cited by examiner

*Primary Examiner*—Jacob Y Choi
*Assistant Examiner*—Jimmy T Vu
(74) *Attorney, Agent, or Firm*—Fay Sharpe LLP

(57) ABSTRACT

A light weight, bobbinless high voltage transformer and igniter module is provided that meets low-cost and high-reliability requirements for automotive HID products. A printed circuit board (112) serves as a carrier for low voltage electronic components. A high voltage bar core transformer (114) is held in a cradle (130, 130') that accommodates potting material and has a channel (160) that receives a high voltage wire extending from the transformer for connection with a lead (104) of an HID lamp (100). Thin walls (210, 212) allow the cradle to serve as the cavity for the potting of the transformer. In addition, multi-layer dielectric material is disposed between the primary and secondary windings. Preferably, the primary winding (196) is a strap that covers a large surface area of the secondary winding (192).

20 Claims, 7 Drawing Sheets

LIGHT WEIGHT AUTOMOTIVE HID IGNITER

This application is related to and expressly incorporates herein by reference commonly-owned U.S. patent application Ser. No. 11/646,009 of Varga, et al., entitled "Lamp Transformer". Cross-reference is also made to commonly owned U.S. patent application Ser. No. 11/646,213, filed Dec. 27, 2006, entitled "Lamp Igniter Module and Transformer Carrier"; Ser. No. 11/646,009, filed Dec. 27, 2006, entitled "Lamp Transformer"; Ser. No. 11/645,879, filed Dec. 27, 2006, entitled "Lamp Transformer Assembly"; Ser. No. 11/513,777, filed Aug. 31, 2006, entitled "Lamp Transformer"; and, Ser. No. 11/710,751, filed Feb. 26, 2007, entitled "High Voltage Transformer and a Novel Arrangement/Method for HID Automotive Headlamps."

BACKGROUND OF THE INVENTION

This disclosure generally relates to a high voltage transformer and igniter module of the type used in a lamp assembly. More particularly, the voltage transformer assembly and igniter module assembly is of the type typically used in an automotive lamp assembly such as a high intensity discharge (HID) lamp.

There is a continuing demand for automotive HID lamps. Just as importantly, there is a continued need for addressing various issues with regard to the final product, reliability, and the overall weight of the assembly. For example, manufacturers over the years have improved on the weight of the headlamp assembly in an effort to contribute to the need to decrease the OEM's desire to reduce the overall weight of an automotive vehicle. Although reductions have been achieved in reaching a weight of approximately 65 grams, further recent improvements in weight reduction have been limited.

Still another area needing improvement in automotive HID lamps relates to the cost to manufacture. For example, it is important that assembly of the lamp components be repeatable, accurate, and reliable, as well as limiting the number of steps on the manufacturing process. For example, it is important to limit the number of welds required to connect electrical components. Likewise, eliminating handling or processing steps typically results in reduced manufacturing costs. Just as important, however, is the improved quality that results from incorporating precise, repeatable steps into the manufacturing process so that overall quality of the resultant product improves. For example, a separate, special fixture is presently required for potting a lamp transformer of the type shown and described in the Ser. No. 11/646,009 application commonly owned by the assignee of the present application.

Further, although bobbinless transformer assemblies are generally known in the transformer art, incorporation into the transformer assemblies used in automotive lamp applications presents unique circumstances in still being able to address high voltage insulation factors. For example, a challenge remains in effectively reducing weight but without impacting on the need to properly insulate for high voltage applications of the type encountered in a compact environment such as an automotive headlamp.

Consequently, improvement is required in reducing weight, improving reliability, limiting manufacturing steps and costs, while providing an improved igniter for a HID headlamp.

BRIEF DESCRIPTION OF THE INVENTION

A lamp transformer assembly includes a transformer having primary and secondary windings. A carrier is dimensioned to receive the transformer and includes a high voltage wire receiving portion formed therein.

The transformer may include a bar core without a bobbin.

A secondary winding is wrapped around the bar core, and a primary winding is wrapped around the secondary winding. Moreover, it is preferred that a single layer or multi-layer dielectric material be disposed between the windings.

The primary winding is preferably a thin strip or strap having a width substantially greater than a thickness.

A carrier is modified to easily receive first and second ends of the transformer.

The carrier in one embodiment accommodates the potting material eliminating use of a separate potting fixture and allowing a one-step potting process by providing thin walls around the transformer.

The strap design of the primary winding also improves the magnetic coupling of the transformer and allows the primary winding to cover a large section or surface area of the secondary winding.

A primary benefit resides in the decreased weight of the automotive HID igniter assembly.

Another benefit is found in the improved handling of the high voltage wire.

Still another benefit relates to improved magnetic coupling between the primary and secondary windings of the transformer.

Yet another benefit is realized by using the transformer carrier as the potting fixture.

Still other features and benefits and advantages are found as will be appreciated from reading and understanding the following detailed description.

DETAILED DESCRIPTION OF THE INVENTION

Figure 1:
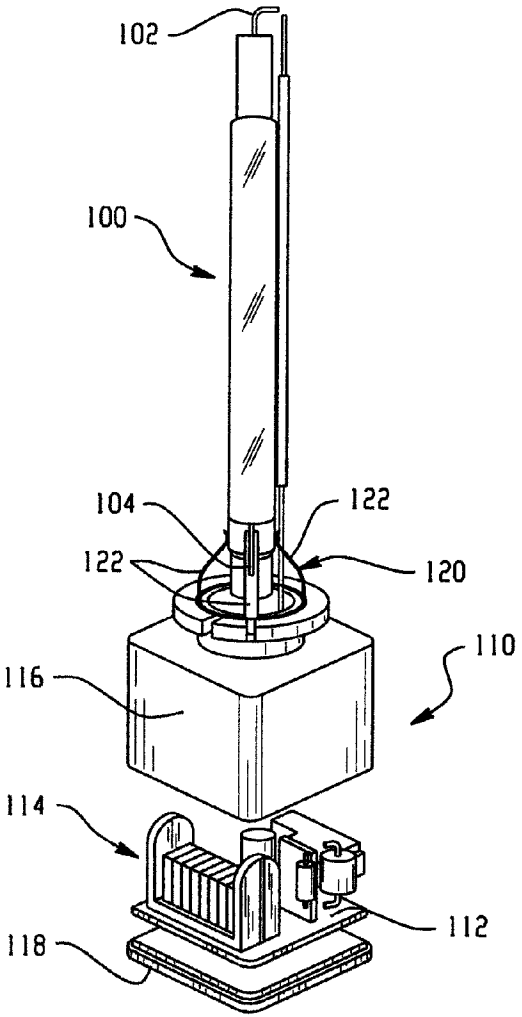
FIG. 1 is an exploded view of a light source or lamp and igniter module assembly.

Turning to FIG. 1, there is illustrated a lamp assembly 100 such as a high intensity discharge (HID) lamp or ceramic metal halide (CMH) lamp, the details of which are generally known in the art. These types of lamps produce an arc between spaced electrodes and ionize a pressurized fill enclosed within an arc tube. The pressurized gas fill may or may not include mercury. The spaced electrodes are electrically and mechanically connected to outer leads 102, 104 that are, in turn, electrically and mechanically connected to a burner assembly or igniter assembly 110. The igniter assembly increases or steps up incoming voltage to an elevated level, for example to a level on the order of 25 kV, to provide an instant start for the discharge lamp 100.

Figure 2:
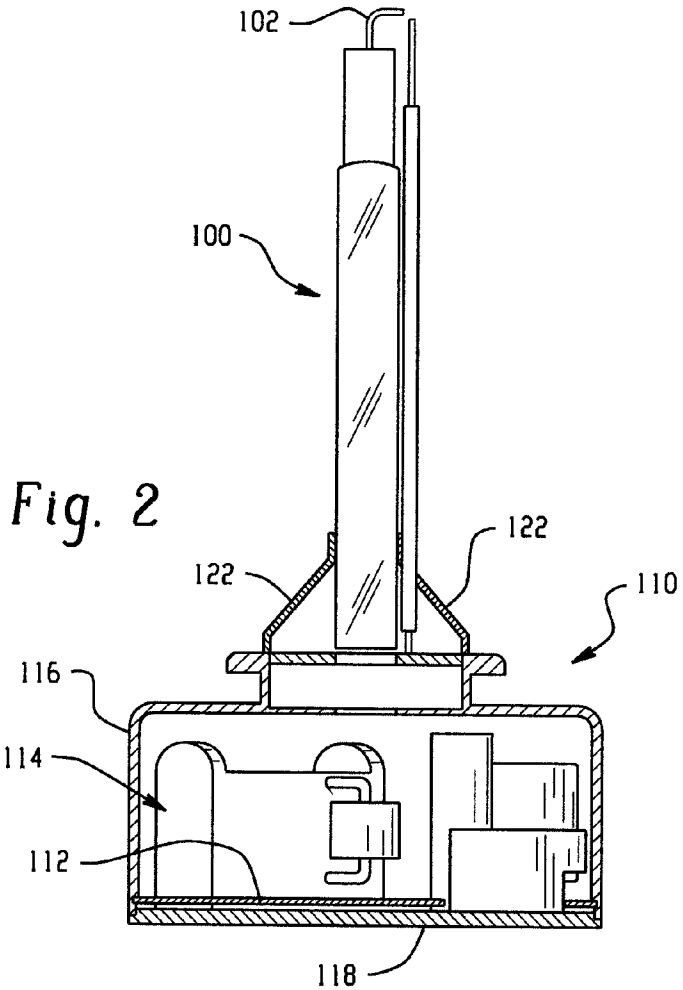
FIG. 2 is an elevational view of the assembled light source mounted to the igniter module assembly.

The igniter assembly includes a printed circuit board assembly 112 that receives a transformer assembly 114 thereon, and which is enclosed within housing 116, an opposite end of which receives a bottom cover 118 in sealed relation to the housing when assembled. A crown 120 is provided on the housing and preferably includes multiple retaining fingers 122 to mechanically engage one end of the lamp assembly 100. FIG. 2 illustrates the assembled lamp assembly with the igniter module assembly 110.

Figure 3:
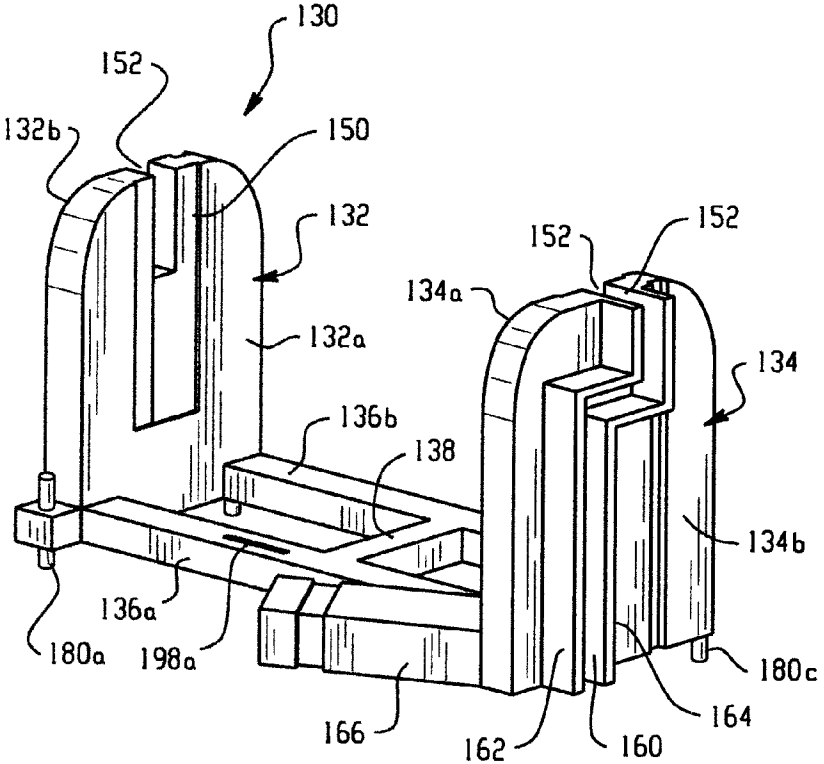
FIG. 3 is a perspective view of one preferred transformer cradle.

FIG. 3 shows one preferred arrangement of a cradle or carrier 130 that is dimensioned to receive a transformer to be described further below. The cradle of FIGS. 3-5 includes first and second generally parallel members or end walls 132, 134. The end walls are held in spaced, generally parallel relation by interconnecting member(s) 136. Here, two spaced interconnecting members 136*a*, 136*b* are connected at opposite ends to the end walls 132, 134. Additionally, a transverse support 138 may also be provided to add rigidity to the spaced interconnecting members. It will also be appreciated that the end members, interconnecting members, and transverse member may all be formed as a one-piece arrangement, such as in a molded plastic. This is desirable for ease of manufacturing and since the plastic can also incorporate pins/supports at selected locations for reasons that will become more apparent below.

First or interior surfaces 132*a*, 134*a* of the respective end members 132, 134 are disposed in facing relation. Each interior surface preferably includes a recess 150 that extends inwardly from an arched end of the end member and terminates at a location above the interconnecting members 136. In addition a through slot 152 is provided in each end member and extends completely through the end member, i.e., 132*a*, 134*a* to external surfaces 132*b*, 134*b*. Moreover, the through slots preferably extend over a limited height of the end members, i.e., less than the height of the recesses 150.

Figure 4:
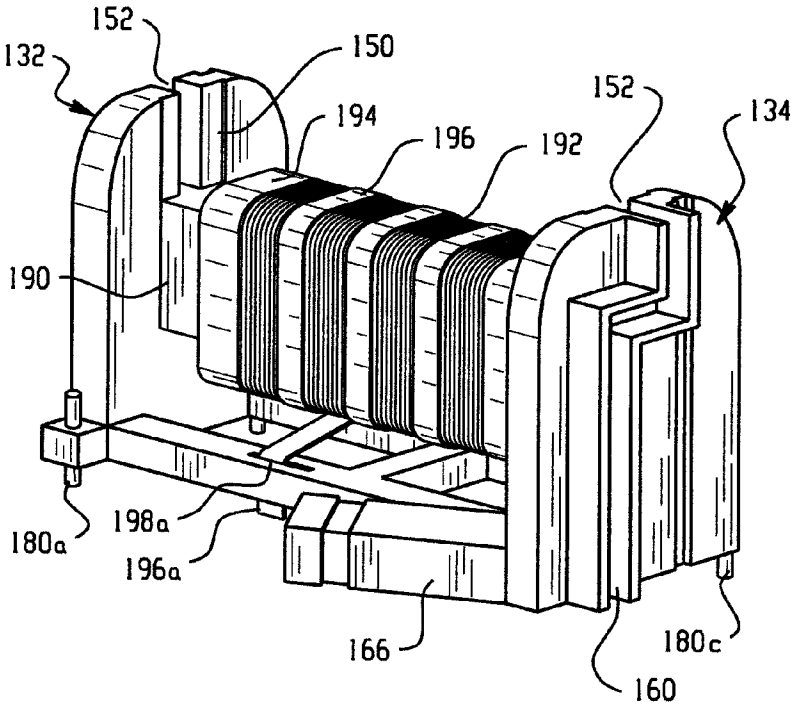
FIG. 4 is a similar perspective view of the cradle of FIG. 3 receiving a bar core transformer assembly.
Figure 5:
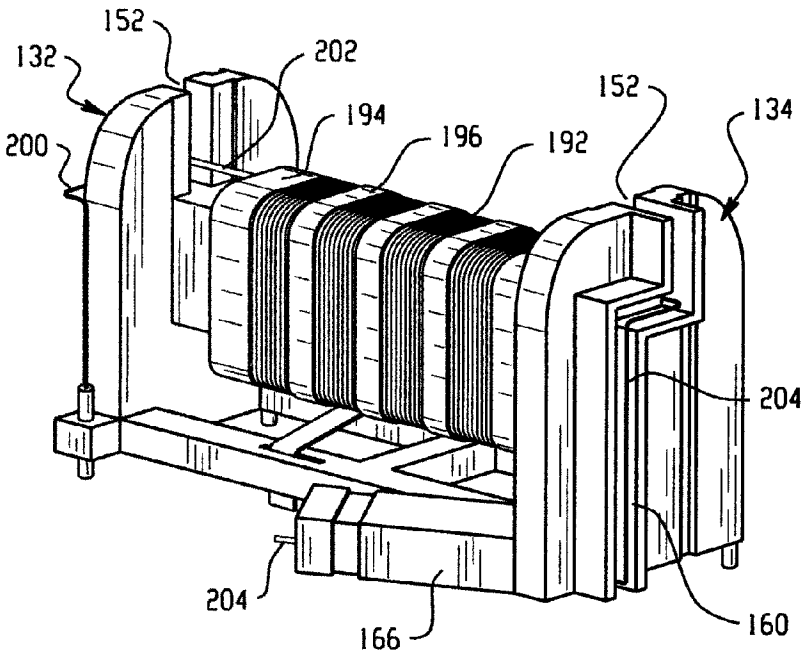
FIG. 5 is a perspective view showing the lead wires and connections to premolded pins in the cradle of FIG. 3.

An outer surface 134*b* of one of the end members (here, the right-hand end member 134 as shown in FIGS. 3-5), includes a high voltage wire receiving portion or channel 160. The channel is formed by a raised pair of walls 162, 164. It will be appreciated by one skilled in the art that the channel can be formed in a variety of ways, and likewise adopt a variety of configurations. However, it is desired that the channel 160 have a depth, or stated another way, that the walls 162, 164 have a height such that the channel depth is sufficient to fully receive diametrical dimension of a high voltage wire leading from the transformer.

In addition, an extension portion shown as angled wall 166 extends from a base portion of end member 134 at an area adjacent the interconnecting member 136*a*. As will be described further below, the angled member 166 includes a channel on an underside thereof that is in operative communication with channel 160 and terminates at a region generally centrally located between the end walls of the carrier.

Conductive pins 180 are preferably located in respective corners of the cradle. The pins serve as either a conductive attachment region, for example for the low voltage wire to be described further below, or simply serve as a locating means or support for the cradle relative to the printed circuit board assembly as will also become further evident below.

As shown in FIG. 4, a bar core transformer is received in the cradle. More particularly, the transformer assembly includes a bar core 190. Wrapped around the conductive core is an insulative material and then is wrapped a relatively thin wire (e.g., on the order of 29 gauge wire) secondary winding 192 that has multiple turns along the length of the bar core. For example, where a prior arrangement may include five layers of secondary windings that would each have one hundred sixty turns total or 53 turns per layer, the present arrangement is substantially less. For example, without limiting the present disclosure, an exemplary arrangement may include only three layers of forty turns in each layer (total number of turns is 120) when used in conjunction with the primary winding of the present disclosure. Preferably, the secondary winding terminates at a location spaced from the end members once the transformer is mounted in the cradle. More particularly, since no bobbin is used in the transformer assembly, margin tape 194 may be provided to hold the secondary windings in place.

Opposite ends of the bar core of the transformer assembly are received within the recesses 150 of the respective end members 132, 134. This cradle design allows the bar core transformer to be inserted from the arched end of the end members toward the interconnecting members. In addition, a primary winding 196 is shown as a thin strip or strap having a width that is substantially greater than a thickness of the strap. This allows the primary winding to cover a substantial surface area of the secondary winding when wrapped therearound as illustrated. This improves the magnetic coupling between the primary and secondary windings without adding more turns on the secondary winding as would be required if a corresponding thin wire were used for the primary winding.

In addition, a multi-layer dielectric material is disposed between the primary and secondary windings to serve as an insulation layer between the windings. Moreover, as noted above the transformer does not include a bobbin. Instead, using the single or multi-layer dielectric material allows the conventional bobbin to be eliminated. Thus, reduced weight is achieved by eliminating use of the bobbin, reducing the number of layers and turns of the secondary winding, and without impacting operability of the transformer assembly.

First and second ends 196*a*, 196*b* of the primary winding pass through corresponding slots 198 in respective interconnecting members 136*a*, 136*b*. The ends 196*a*, 196*b* of the primary winding are interconnected to the printed circuit board.

FIG. 5 is similar to FIG. 4, however, low voltage and high voltage wires of the transformer are additionally shown in the assembly. Particularly, a low voltage lead wire 200 extends from a first end of the transformer assembly and passes through the slot 152 in the first end member 132. The lead wire 200 is routed for interconnection and soldering (i.e., electrically and mechanically connected) to one of the pins 180*a*, preferably through a solder interconnection. To provide further support and insulation for this lead wire as it passes through the slot, a dielectric sleeve 202 is received over the low voltage lead wire, at least through the region where the lead wire passes through the slot 152.

At the other end of the cradle assembly, a high voltage lead wire 204 extends from the other end of the transformer, passes through slot 152 and is received in the recess 160. Likewise, the high voltage lead wire preferably has an insulating sleeve along at least a portion thereof where the lead wire passes through the slot 152. The high voltage lead wire continues through the angled arm 166, and particularly, as better illustrated in FIG. 9, through groove 206 provided in the underside of the angled arm 166. In this manner, the lead wire is substantially covered or contained as it proceeds from the end of the transformer, along the second end member 134, and routed to a more central location for connection with the lamp lead and the printed circuit board to be described below.

Figure 6:
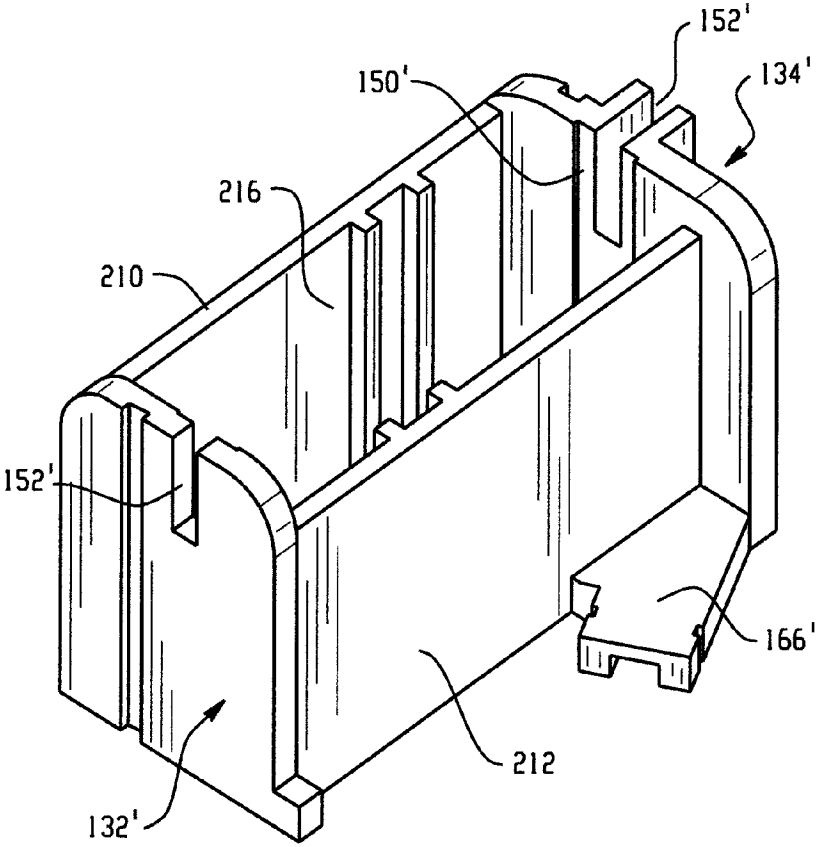
FIGS. 6-8 are perspective views of a second preferred cradle assembly without the transformer.
Figure 8:
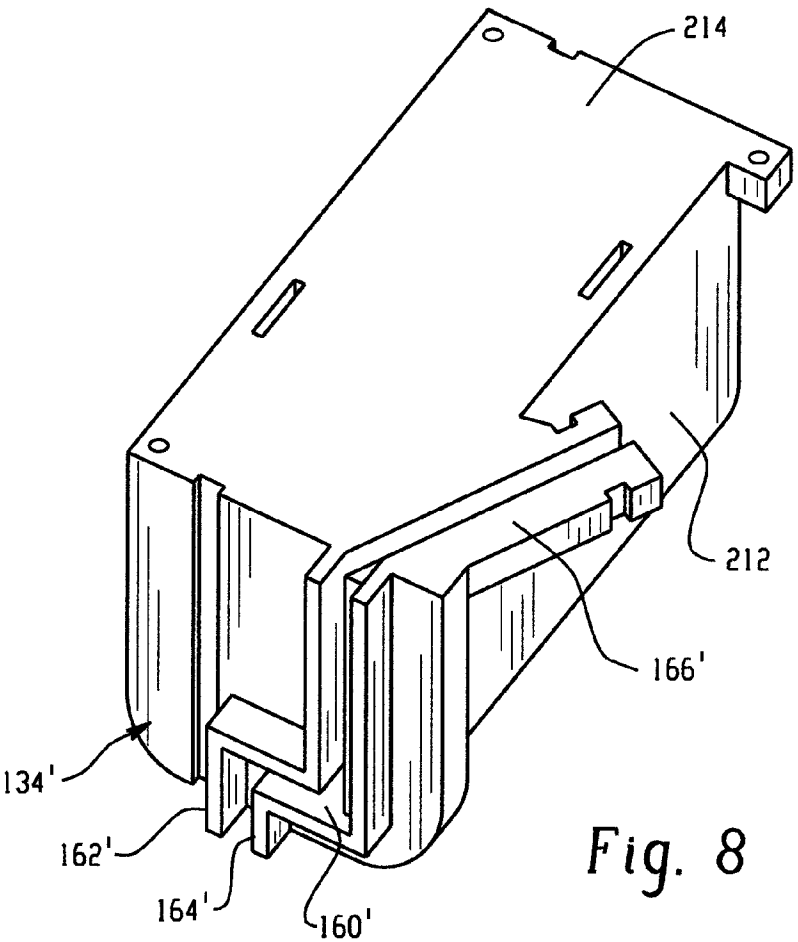
Figure 7:
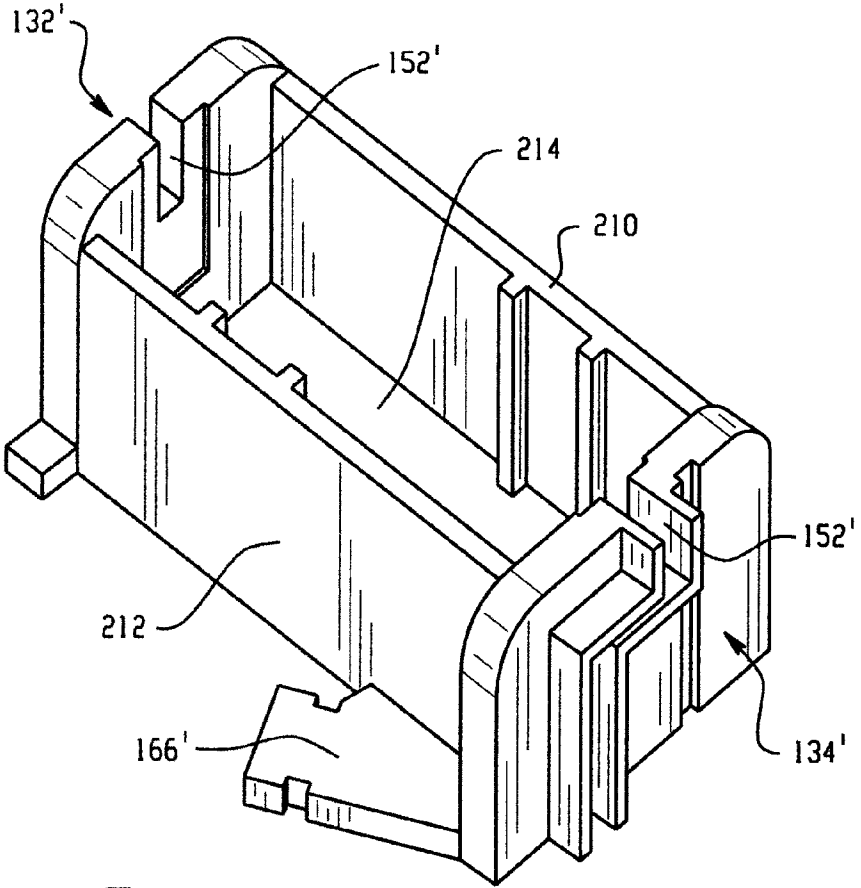

FIGS. 6-8 illustrate a second embodiment of a cradle assembly where like elements are identified with like reference numerals with a primed (') suffix, while new components are identified with new reference numerals. A pair of side walls 210, 212 and a continuous bottom wall 214 are provided and interconnect the end members 132', 134' and angled member 166'. The transformer has been removed for ease of illustration. As is evident, slot 152' proceeds through the end wall 132', and likewise slot 152' extends entirely through end wall 134'. The sidewalls 210, 212 and bottom wall 214 form a central cavity 216 dimensioned to receive the transformer when the transformer is slid in along recesses 150' provided along each interior face of the end members.

Figure 9:
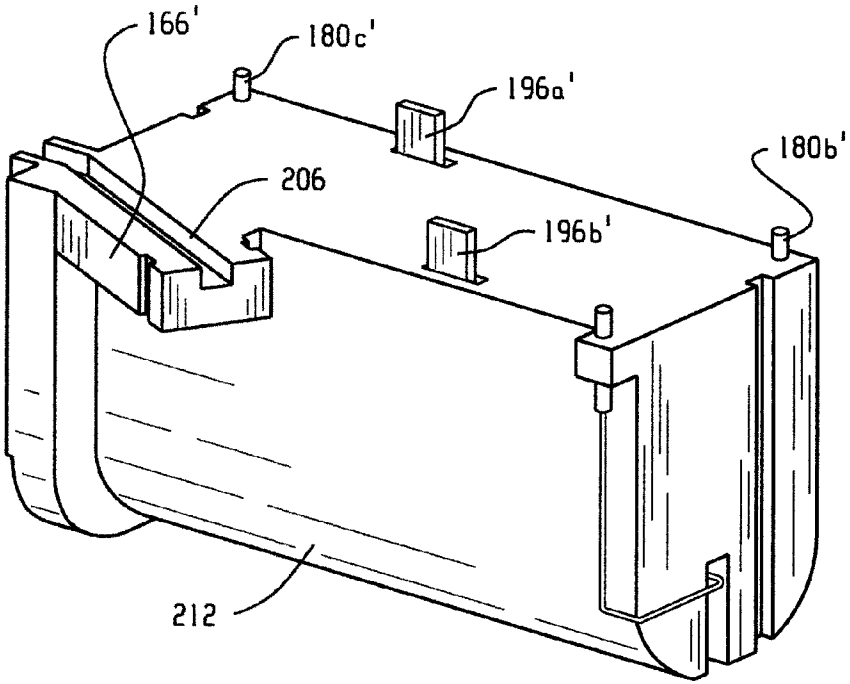
FIG. 9 is a perspective view of the assembled cradle assembly of FIGS. 6-8 housing a transformer from the underside as a part of the potting process.

As shown in FIG. 9, the cradle assembly with the transformer installed therein, is then ready for potting. Selective openings or crevices must be sealed. Particularly, slots 196 that receive opposite ends of the primary winding strap, and the slots 152 provided in each end member are closed or plugged. Once plugged, the cavity 216 is filled with a suitable potting material and cured. In this manner, the cradle assembly essentially serves as the potting fixture so that minimal setup and processing time is required. It will be appreciated that the embodiment of FIGS. 3-5 will require the cradle with installed transformer to be placed in a separate potting fixture.

Figure 10:
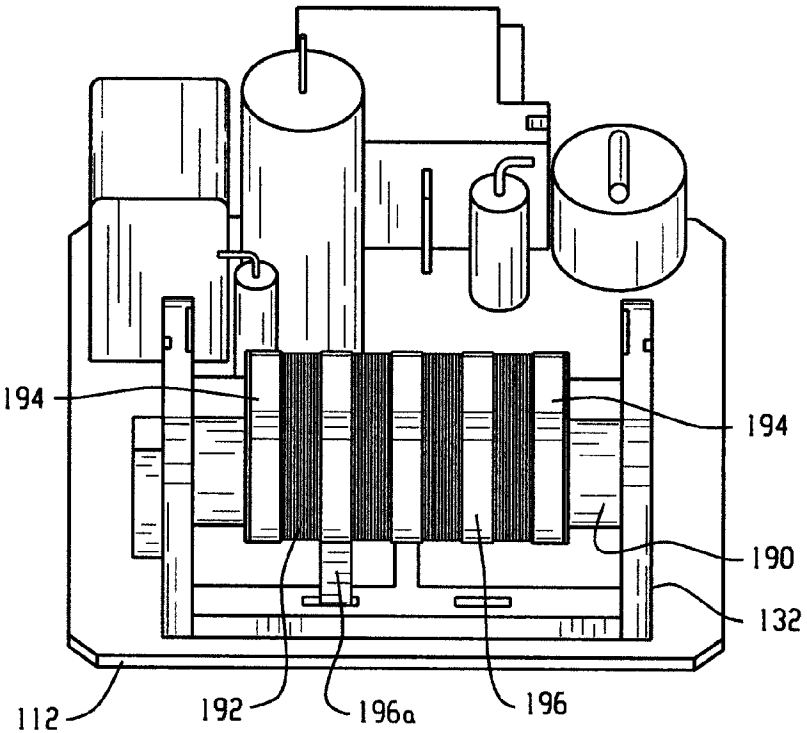
FIG. 10 illustrates installation of a potted transformer-cradle assembly onto a printed circuit board.

FIG. 10 illustrates the potted transformer/cradle assembly installed on the upper surface of the printed circuit board 112. The potting sidewalls are not shown in order to permit an illustration of the transformer received in the potting material. Other electrical components, forming no particular part of the present invention, are shown as being electrically and mechanically connected to the printed circuit board.

Figure 12:
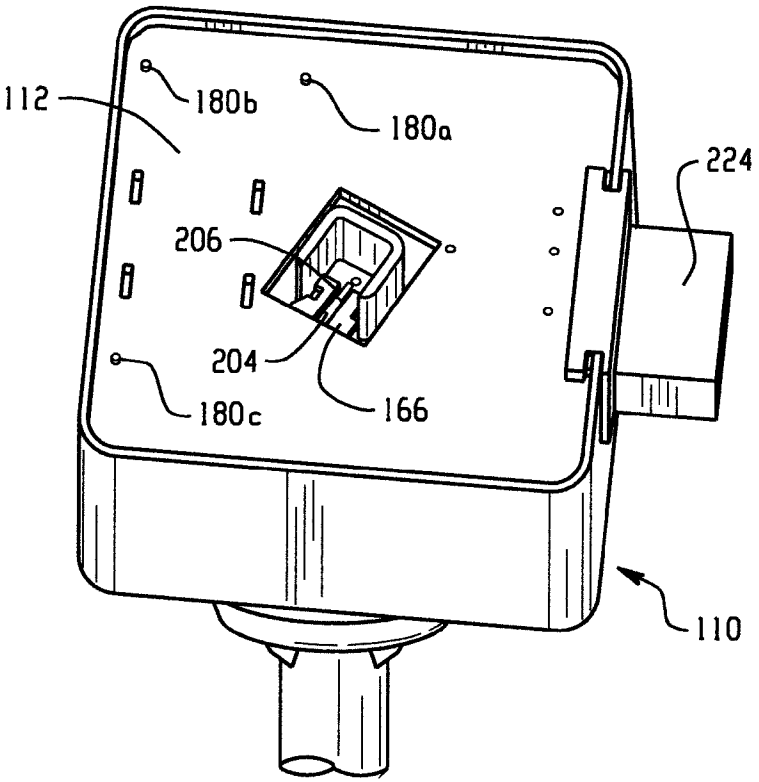
FIG. 12 shows an igniter module positioned in a housing and insertion of a HID lamp into an associated socket.
Figure 11:
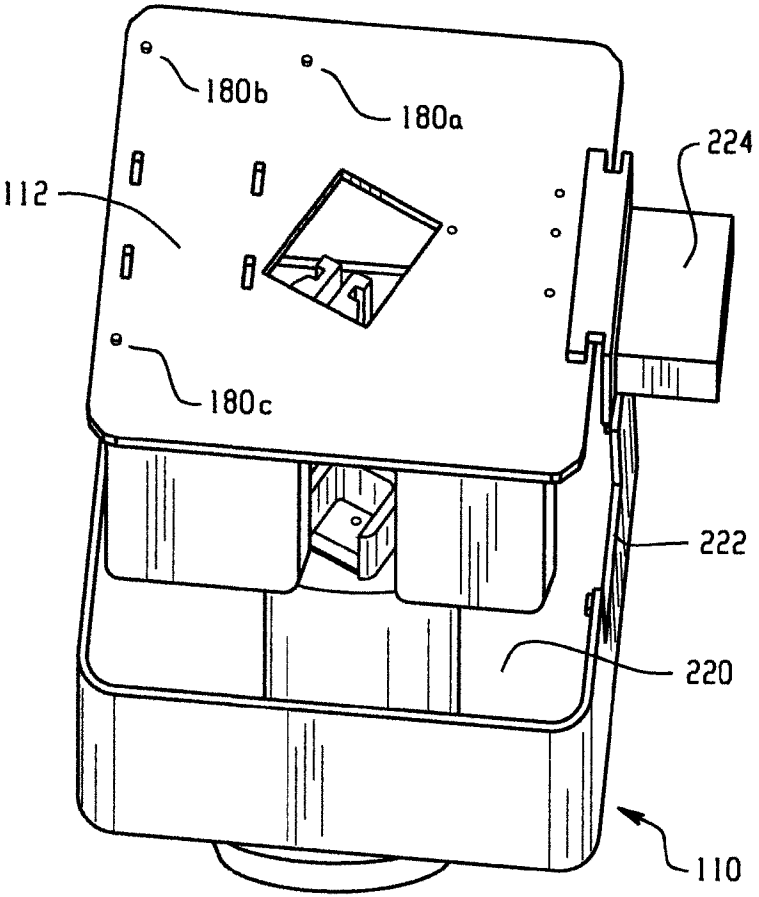
FIG. 11 shows installation of an assembled igniter module into a housing.
Figure 14:
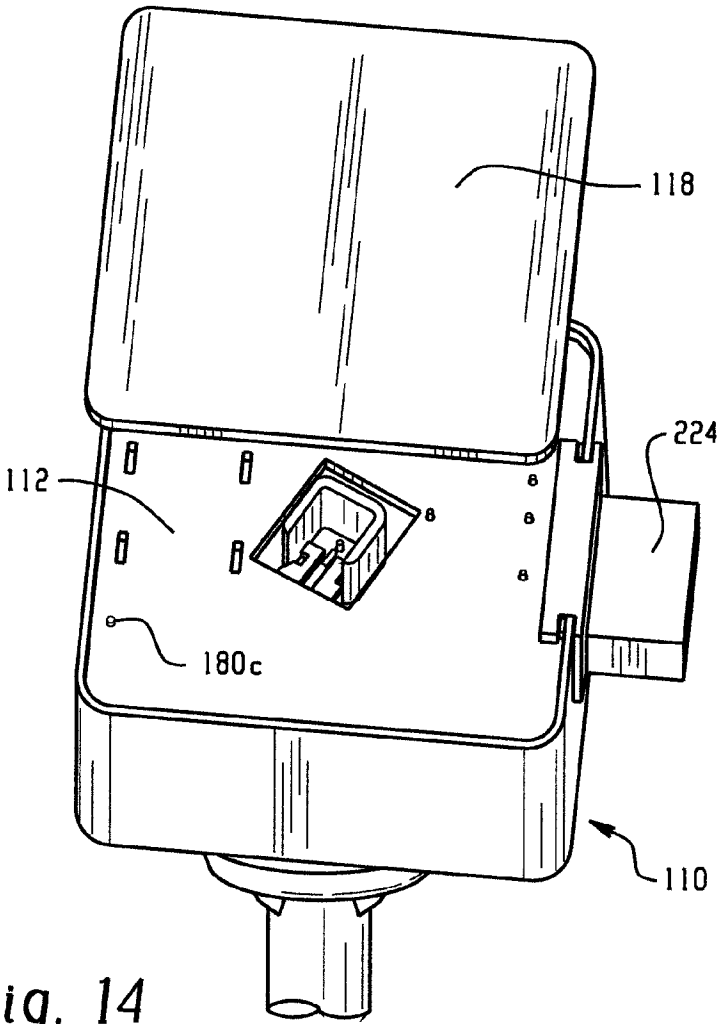
FIG. 14 illustrates placement and securing of a bottom plate to the housing.
Figure 13:
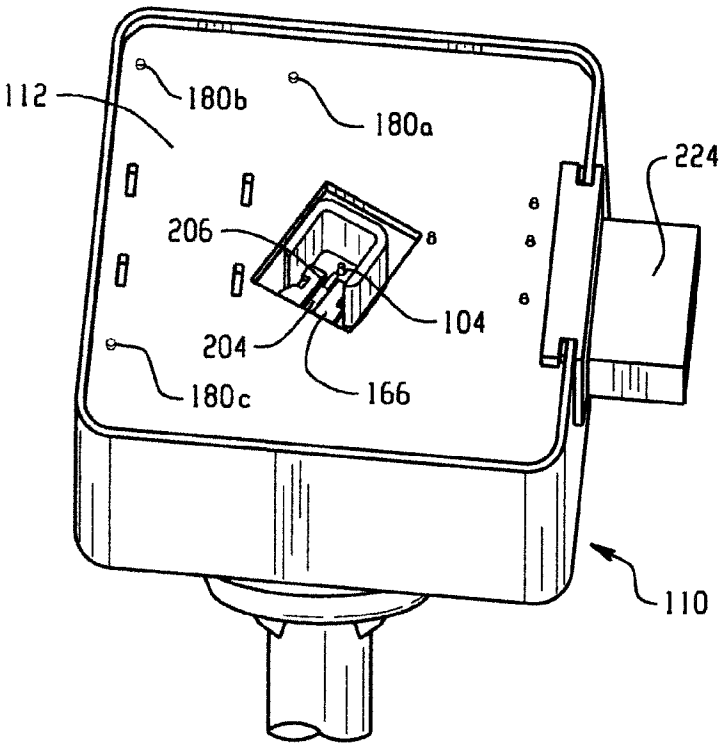
FIG. 13 is an enlarged view of an underside of an igniter module of the type shown in FIG. 12.

The printed circuit board 112 with installed components is tested and, if qualified, the igniter board is then installed into the housing 110, and particularly into cavity 220 through the lower, open end. A sealant is provided along a connector receiving recess 222 in the housing in order for the connector 224 to be sealingly and securely secured to the housing. FIG. 11 illustrates complete insertion of the igniter module into the open end of the housing and illustrates how peripheral grooves in the connector 224 are received on either side of the sidewall of the housing to resist pull-out forces and securely position the printed circuit board in the housing. As shown in FIG. 12, the end of the high voltage wire 204, where the high voltage wire exits the groove 206 of the angled arm 166, is then accurately positioned adjacent the lamp lead 104. The lamp lead and high voltage transformer wire are then welded or otherwise mechanically and electrically connected, and in addition, the secondary lamp lead that interconnects with the outer lead 102 is welded or otherwise mechanically/electrically connected to the printed circuit board. Thereafter, potting material is used to cover these interconnections. Next, the cover 118 is aligned over the open end of the housing and fusion bonded or otherwise secured along its perimeter to provide a sealed mechanical connection with the housing.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A lamp transformer assembly comprising:

a transformer used in a headlamp that includes a light source including primary and secondary windings, and a bar core around which are wrapped the secondary winding and the primary winding where the primary winding is a strip material having a width substantially greater than a thickness thereof;

a carrier dimensioned to receive the transformer therein and having a high voltage wire receiving portion formed therein as a channel dimensioned to receive and isolate the high voltage wire; and an igniter module operatively associated with the light source for selectively powering the light source, the igniter module including a cradle receiving the transformer, wherein the channel extends toward a central location beneath the light source whereby the high voltage wire is isolated in the channel as the wire proceeds from the transformer to a lamp lead.

2. The transformer assembly of claim 1 wherein the transformer includes a bar core without a bobbin.

3. The transformer assembly of claim 2 wherein the secondary winding is wrapped around the bar core, and the primary winding is wrapped around the secondary winding.

4. The transformer assembly of claim 1 wherein the secondary winding is wrapped around the bar core, and the primary winding is wrapped around the secondary winding.

5. The transformer assembly of claim 4 further comprising a layer of dielectric material disposed between the windings.

6. The transformer assembly of claim 1 wherein the primary winding includes a thin strip having a width substantially greater than a thickness.

7. The transformer assembly of claim 1 wherein the carrier includes a first wall having a surface facing an interior surface of a second wall, each interior surface including a recess dimensioned to receive a respective end of the transformer.

8. The transformer of claim 7 wherein the high voltage wire receiving portion includes an open-topped channel dimensioned to receive an outer periphery of an associated high voltage wire.

9. The transformer assembly of claim 7 wherein the transformer includes a bar core and opposite ends of the bar core are received in the respective recesses of the interior surfaces.

10. The assembly of claim 1 wherein the primary and secondary windings are interleaved with an insulative wrap.

11. The assembly of claim 10 wherein the bar core transformer is bobbinless.

12. The assembly of claim 1 wherein the igniter module further includes a cradle receiving the transformer along five of six mutually perpendicular sides thereof and open along the sixth side so that the cradle can be used for potting the transformer.

13. The assembly of claim 12 wherein the cradle includes recesses extending along parallel surfaces from the open sixth side for receiving the transformer.

14. A lamp transformer assembly comprising:

a transformer including primary and secondary windings;

a carrier including a first wall having a surface facing an interior surface of a second wall, each interior surface including a recess dimensioned to receive a respective end of the transformer and dimensioned to receive the transformer therein and having a high voltage wire receiving portion formed in the first wall that includes a channel formed by first and second spaced apart, substantially parallel sides having a height dimensioned to receive an outer periphery of an associated high voltage wire therein.

15. The transformer assembly of claim 14 wherein the transformer includes a bar core and opposite ends of the bar core are received in the respective recesses of the interior surfaces.

16. The transformer assembly of claim 14 wherein the transformer includes a bar core without a bobbin.

17. The transformer assembly of claim 16 wherein the secondary winding is wrapped around the bar core, and the primary winding is wrapped around the secondary winding.

18. The transformer assembly of claim 16 wherein the secondary winding is wrapped around the bar core, and the primary winding is wrapped around the secondary winding.

19. The transformer assembly of claim 14 further comprising a layer of dielectric material disposed between the windings.

20. The transformer assembly of claim 14 wherein the primary winding includes a thin strip having a width substantially greater than a thickness.

* * * * *